US005372349A

United States Patent [19]

Elmore

[11] Patent Number: 5,372,349

[45] Date of Patent: Dec. 13, 1994

[54] SINGLE FORM SYSTEM AND METHOD FOR MOLDING PRE-CAST STRUCTURAL WALL PANELS OF DIFFERENT SIZES FOR DIFFERENT TYPES OF WALL SYSTEMS

[75] Inventor: J. Thomas Elmore, Washington, D.C.

[73] Assignee: JTE, Inc., Lorton, Va.

[21] Appl. No.: 52,908

[22] Filed: Apr. 27, 1993

[51] Int. Cl.[5] ..... B28B 7/02; B28B 7/36

[52] U.S. Cl. ..... 249/112; 249/155; 249/156; 249/158; 249/160; 249/165; 249/166

[58] Field of Search ..... 249/112, 139, 155, 156, 249/160, 165, 166, 18, 28, 188, 82, 134, 16

[56] References Cited

U.S. PATENT DOCUMENTS

| | | | |
|---|---|---|---|
| 901,740 | 10/1908 | Reed | 249/156 |
| 1,007,452 | 10/1911 | Korneffel et al. | 249/112 |
| 1,125,986 | 1/1915 | Edington et al. | 249/112 |
| 2,215,160 | 9/1940 | Rothmann | 249/82 |
| 2,315,634 | 4/1943 | McCall | 249/165 |
| 2,416,559 | 2/1947 | Wilson . | |
| 2,688,788 | 9/1954 | Archer | 249/156 |
| 2,758,353 | 8/1956 | Carlson et al. | 249/112 |
| 2,870,517 | 1/1959 | Henderson . | |
| 3,205,552 | 9/1965 | Johnson et al. | 249/155 |
| 3,618,886 | 11/1971 | Graham | 249/13 |
| 3,625,468 | 12/1971 | Marcott | 249/165 |
| 3,704,852 | 12/1972 | Wellander | 249/50 |
| 3,759,481 | 9/1973 | Scott | 249/16 |
| 3,890,415 | 6/1975 | Hull | 249/112 |
| 4,131,405 | 12/1978 | Moore | 425/143 |
| 4,132,046 | 1/1979 | Duane et al. | 249/156 |
| 4,141,532 | 2/1979 | Wall | 249/156 |
| 4,159,100 | 6/1979 | Landowski | 249/99 |
| 4,482,126 | 11/1984 | Toffolon | 249/159 |
| 4,614,325 | 9/1986 | Muldery et al. | 249/120 |
| 4,679,768 | 7/1987 | Brotherton | 249/189 |
| 4,969,626 | 11/1990 | Strauch | 249/94 |
| 5,202,132 | 4/1993 | Myers et al. | 249/112 |

FOREIGN PATENT DOCUMENTS

| | | | |
|---|---|---|---|
| 4-49371 | 2/1992 | Japan | 249/16 |
| 460980 | 2/1937 | United Kingdom | 249/112 |
| 786556 | 11/1957 | United Kingdom | 249/165 |
| 1215770 | 12/1970 | United Kingdom | 249/136 |
| 2100659 | 1/1983 | United Kingdom | 249/112 |
| WO93/01924 | 2/1993 | WIPO | 249/155 |

*Primary Examiner*—Khanh Nguyen

*Attorney, Agent, or Firm*—Sixbey, Friedman, Leedom & Ferguson

[57] ABSTRACT

A form system and method is provided that is capable of molding pre-cast, structural wall panels of different lengths, widths, thicknesses and architectural finishes for a variety of different types of wall systems. The form system comprises a base assembly formed from at least one rectangular base, a plurality of form liners supportable by the base assembly for defining the bottom of a mold space and for imparting different architectural finishes to panels molded thereby, a pair of elongated side wall members for defining the sides of the mold space, a plurality of vertically-oriented slots and bolts in each of the elongated side wall members for adjustably mounting these members at different heights with respect to the base assembly, an alignment flange on the inside surfaces of each of the side wall members engagable against the side edges of the selected form liner for aligning each of the side wall members to a proper height with respect to the form liner, and end wall members detachably connectable between the two side wall members for defining the end walls of the mold space. The system of the invention is capable of molding panels for mechanical stabilized earth walls, acoustical walls, pile and lagging walls, or post and panel walls quickly, reliably, and dimensionally consistently with only a relatively few easily adjustable components.

19 Claims, 5 Drawing Sheets

SINGLE FORM SYSTEM AND METHOD FOR MOLDING PRE-CAST STRUCTURAL WALL PANELS OF DIFFERENT SIZES FOR DIFFERENT TYPES OF WALL SYSTEMS

BACKGROUND OF THE INVENTION

This invention generally relates to form systems and methods for the molding of pre-cast structural components, and is specifically concerned with a system for the molding of pre-cast structural wall panels in a variety of different shapes, widths, architectural finishes for use in sound walls, mechanically stabilized earth walls, and anchored and gravity wall systems.

Forms for producing pre-cast concrete wall panels are well known in the prior art. Such forms are typically assembled from either wood or metal, and serve as molds for the manufacture of a particular kind of wall panel (i.e., a panel for use in a pile and lagging wall, acoustical wall, or post and panel wall) having a particular kind of architectural finish on its exposed side. In some kinds of walls, the architectural finish may be a simple, flat finish. However, in more decorative walls, the exposed side of the panel may have a brick-type finish, a vertical groove finish, a fractured fin finish, or even an imitation stone finish. In the case of acoustical walls, vertical flutes are commonly molded into the front face of the panels for sound-trapping purposes. The bottom surface of the mold is embossed with the architectural finish that is desired on the outer face of the resulting panel, while the side and ends of the form define the outer shape and thickness of the resulting panel. In use, after the forms have been assembled, structural panels are molded within them by first laying a pattern of reinforced steel within the mold space defined in their interior, and then by pouring liquid concrete into the form. After the concrete hardens, one or more of the sides or ends of the form is loosened from the hardened concrete, and the wall panel is withdrawn from the form. The process is repeated until the desired number of wall panels is manufactured.

While such prior art form systems are capable of satisfactorily producing the particular type and size of structural or architectural wall panel that they were designed for, the applicants have observed a number of areas where such form systems could stand improvement. For example, most prior art form systems are capable of producing wall panels of only a single size for a single type of wall system. However, due to the variations in the spacing between the piles or other members which support such wall panels in the finished wall, and further due to height variations in the finished wall, no single size of wall panel is capable of meeting all applications, even in the same type of wall. For example, in pile and lagging type walls, the distance between the support piles can vary between 6 and 10 feet. For sound walls, support pile distances can vary even further, i.e., between 10 and 20 feet. Of course, the ultimate height of the finished wall varies considerably, depending upon the purpose of the wall and the surrounding terrain. Thus there is a need for a form system capable of producing panels having widths of anywhere between 6 and 20 feet, and heights that similarly vary. However, the applicants are not aware of any prior art form system that is easily and accurately capable of producing panels over such a large variety of sizes. Still another shortcoming associated with prior art form systems is their relative inability to produce sound panels having different architectural finishes (i.e., vertical groove, fractured fin, or imitation brick, etc.) or even different thicknesses. Instead, known form systems utilize separate, dedicated forms for producing each different size of panel in each different type of architectural finish and thickness. Moreover, many prior art form system create structural wall panels in shapes which are relatively difficult to vertically or horizontally enlarge or contract should the need arise, such as hexagons, or cruciforms.

Clearly, what is needed is a form system and method that is capable of producing structural wall panels over a wide range of dimensions in order to accommodate widely varying spacing between the pilings or other support members which hold the finished wall in place, or connect it to earth reenforcing members. Moreover, such a form system and method should be easily and quickly adjustable to produce structural wall panels of radically different sizes with a minimum of time and labor. To this end, such a system and method should produce the wall panels in a shape which is readily enlarged or contracted with a minimum amount of mechanical adjustments. Moreover, such a system and method should be capable of producing not only different sizes of panels, but panels for different types of wall systems (i.e., soundwalls, MSE walls, anchored walls, etc. ) and of different designs as well. It would be desirable if the form system and method allowed the architectural finish that is embossed on the outer face of the wall panels to be changed in an easy and rapid manner. Finally, such a system and method should be capable of consistently producing panels of a selected height, width, and thickness consistently within relatively tight tolerances, so that the resulting panels fit together tightly in the finished wall. This last criteria is particularly important with respect to sound walls, where gaps between adjacent panels can provide undesirable acoustical leaks.

SUMMARY OF THE INVENTION

Generally speaking, the invention is both a form system and method that is far more versatile than prior art concrete forms, and which eliminates or at least ameliorates the aforementioned problems associated therewith. The form system of the invention generally comprises a base assembly that includes at least one rectangular base for supporting a quantity of concrete; at least one form liner supported by the base assembly for defining the bottom of a mold space and for imparting an architectural finish to panels molded by the form system; at least one pair of elongated side wall members for defining the sides of said mold space; means for adjustably securing the side wall members on opposing sides of the base assembly at a plurality of different heights; means for aligning the upper edges of each of the side wall members at a preselected height relative to the side edges of the form liner to define the thickness of the panels molded by the system; end wall members for defining the end walls of the mold space, and means for detachably mounting the end wall members transversely between the side wall members at any one of a plurality of positions in order to determine the length of the mold space defined by the resulting form.

The alignment means may include a flange which extends along the longitudinal axis of each of the side wall members for engaging one of the side edges of the form liner such that the height of the upper edge of each of the side wall members always stands a preselected distance from the form liner regardless of differences in the distances between the side edges of different form liners, and the base assembly which they overlie. The adjustable securing means that detachably connects the side wall members to the base assembly may include a plurality of vertically oriented slots alignable with welded nuts in the base assembly, such that a plurality of bolts may be used to secure the side wall members to the base assembly between maximum and minimum heights determined by the vertical length of the slots.

The means for detachably mounting the end wall members to the form may include opposing bracket members mounted along the top edge of each of the end wall members, and a plurality of bolts and welded nuts for securing bracket members onto the top portions of the side wall members at various locations along the longitudinal axis of the side wall members in order to define the length of any form manufactured from the resulting mold. A plurality of spaced apart welded nuts are provided at both ends of each of the side wall members so that each of the end wall members may be positioned at a variety of different distances at either end of the resulting form. The adjustability of both end wall members allows the form system to mold not only structural wall panels of a variety of different lengths, but wall panels having symmetrically-disposed architectural finishes on them.

Extension members may be provided for additionally extending the height of each of the side wall members so that the form system can mold structural wall panels that are thicker, if desired. These extension members may each include an angular piece of steel that is bolted into engagement with the upper inner edge of its respective side wall member. When such extension members are used, tubular spacers may be used in conjunction with the bracket and bolt means for connecting the end wall members over the side wall members so as to avoid interference between the brackets and the height extension members mounted on the upper inner edges of the side wall members.

Additionally, base width extenders may be provided for extending the width of the base assembly. In the preferred embodiment, each such base with extender may be bolted onto one of the sides of the base assembly through the same bolt holes that would normally serve to connect the side wall members to the base assembly. When so connected, the floor of the base width extender is aligned with the floor of the base assembly to create a single, continuous mold bottom. The outer side walls of each base width extender includes the same pattern of bolt holes as the sides of the base assembly to allow for the connection of the side walls of the form thereon.

In the method of the invention, a base assembly is first formed from either a single base, a pair of bases detachably connected into end, or a pair of bases attachably connected side-to-side, or four such bases connected end-to-end and side-to-side. Next, a form liner sufficiently large to cover substantially all of the upper area of the base assembly is laid over the upper surface of the base assembly. The flange means of two opposing side wall members is then overlaid into engagement with the side edges of the form liner so as to adjust the upper edges of each of the side wall members to the proper distance with respect to the inner surface of the form liner. Next, the bolts which secure the side wall members to the base assembly through the previously described vertically-oriented slots are tightened to secure each of the side wall members into its proper position. The end wall members are then detachably secured over opposite ends of the form liner by the bracket and bolt connecting system at selected positions along either end of the longitudinal axis of the respective side members to define a mold space capable of producing wall panels of a selected length.

The ability of the bases of the form system to interconnect into base assemblies of varying sizes, coupled with the height adjustability features of the side wall members, allows the system of the invention to produce structural wall panels of a variety of different dimensions and thicknesses in a rapid and economical manner.

BRIEF DESCRIPTION OF THE SEVERAL FIGURES

DETAILED DESCRIPTION OF THE PREFERRED EMBODIMENT

Figure 1A:
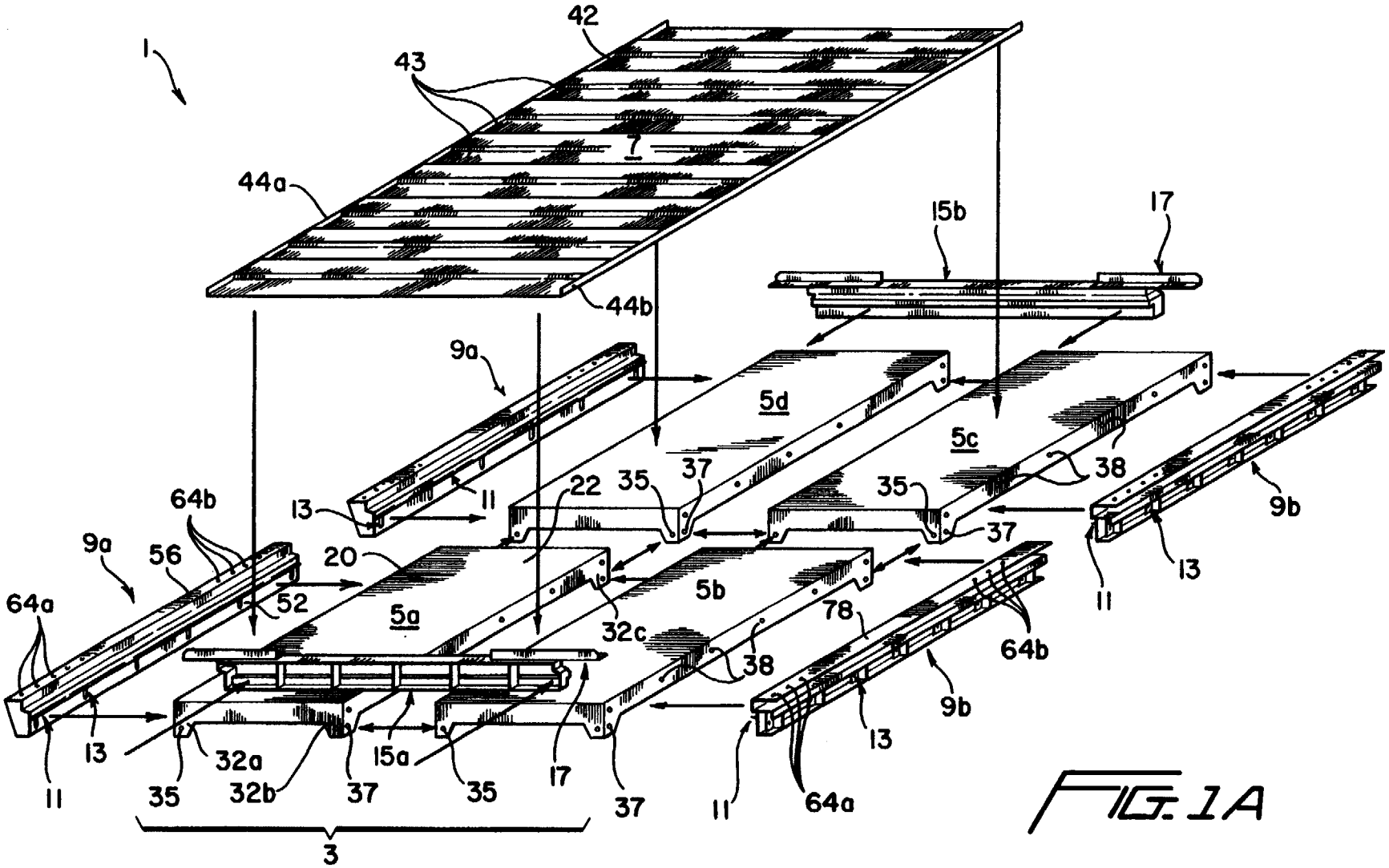
FIG. 1A is an exploded, perspective view of the form system of the invention illustrating both the principal components of the system and the manner in which they fit together, illustrating in particular how a single large base assembly may be formed by bolting together four separate bases.
Figure 1B:
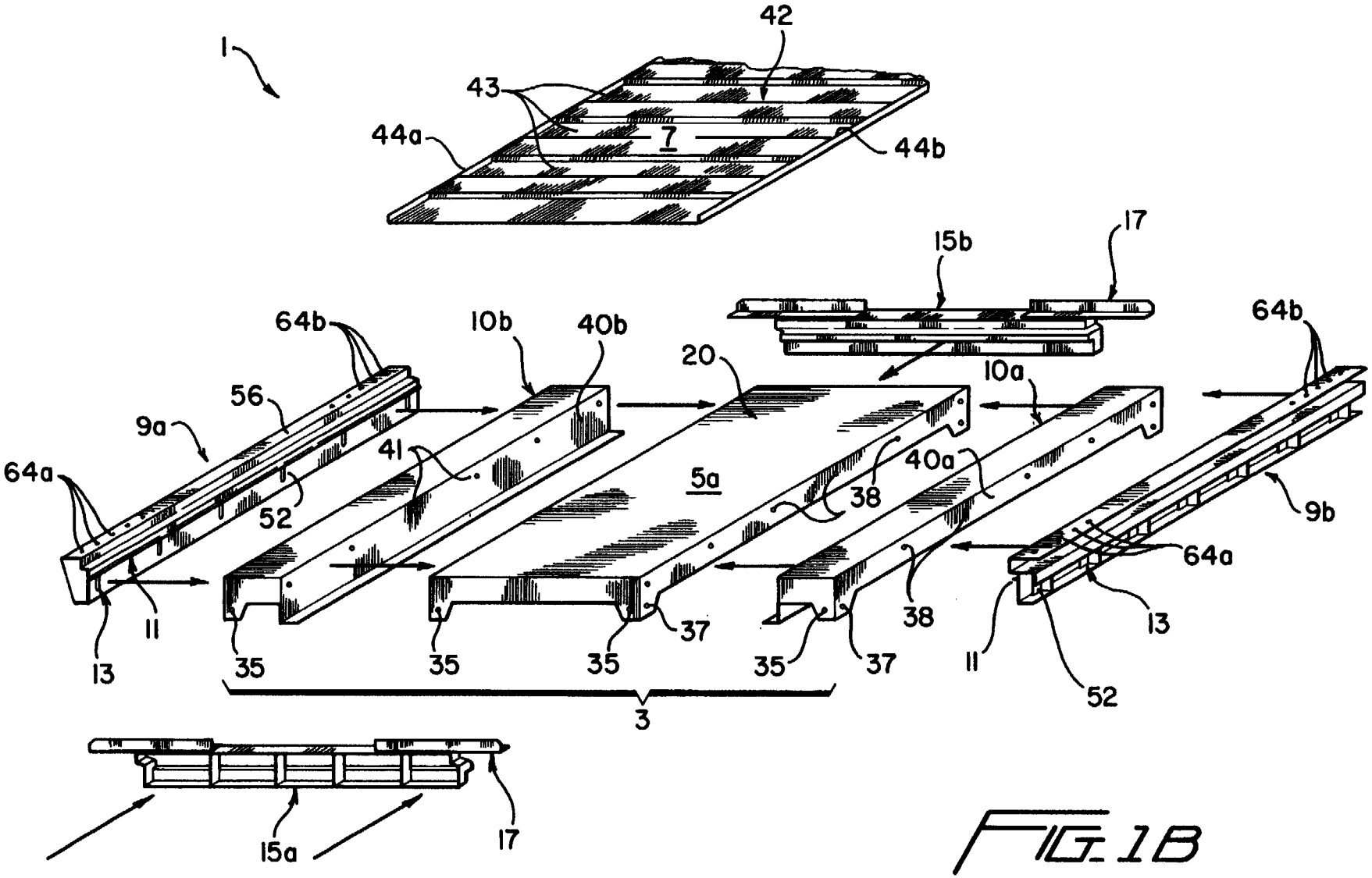
FIG. 1B is an exploded, perspective view of the form system, illustrating how base width extenders may be mounted on the sides of the base assembly to extend the width of the base assembly.
Figure 2:
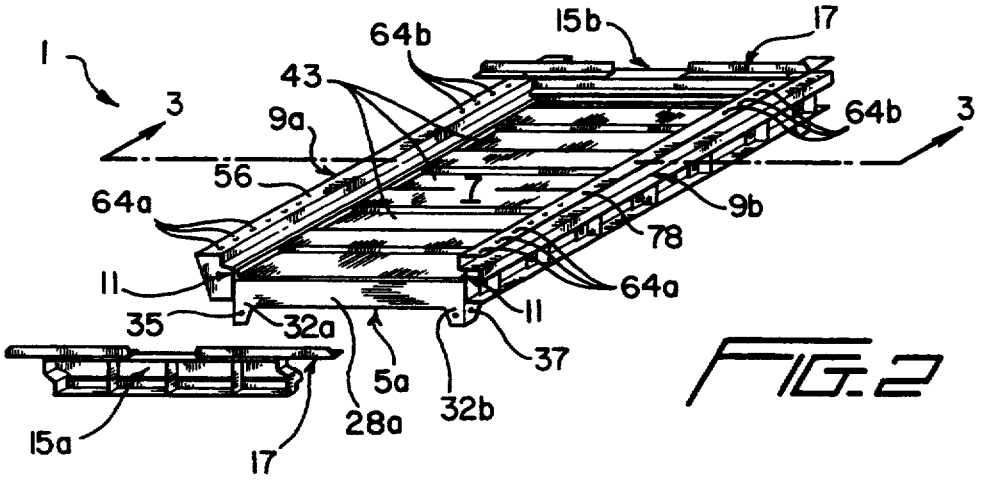
FIG. 2 is a perspective, partially exploded view of the form system of the invention illustrating how the system appears when it is substantially assembled, and when only a single base forms the base assembly of the system.

With reference now to FIGS. 1A,B and 2, wherein like numbers designate like components throughout all the several figures, the form system 1 of the invention includes a base assembly 3 which may be formed from either a single base 5*a* (as is illustrated in FIG. 2), or any combination of bases 5*a–d* bolted together end to end, side to side, or both ways as FIG. 1A indicates. The identical rectangular shape of each of the individual bases 5*a–d*, allows the operator of the system 1 to conveniently double either the length or width, or both the length and the width of a single base. The system 1 further includes a plurality of sheet-like form liners 7 (of which only one is shown) which are dimensioned so that they cover most or substantially all of the top surface of the base assembly 3. Also included are a plurality of left and right side wall members 9*a,b*. Each side wall member is aligned at a proper height with respect to the form liner 7 by means of an alignment mechanism 11 after the liner 7 has been disposed on top of the base assembly 3. Each side wall member is further detachably secured into this aligned position by means of a height adjustable mounting system 13. As will be described in more detail hereinafter, the height adjustable mounting system 13 generally comprises a plurality of bolts which extend through vertically-oriented slots in each of the side wall members 9*a,b* and which threadedly engage the bases 5*a–d* through bolt holes located along the sides of each base. As is shown in FIG. 1B, the system 1 further includes base width extenders 10*a,b* for extending the width of a single base 5*a*. Finally, the system 1 includes a pair of end wall members 15*a,b* which are detachably connected between the side wall members 9*a,b* and over the upper surface of the form liner 7 by means of a length adjustable mounting system 17. As is described in more detail hereinafter, the mounting system 17 allows each of the wall members 15*a,b* to be bolted at a desired position along the longitudinal axis of the base assembly 3, which in turn allows the system operator to choose the length of the panels molded in the forms.

Figure 3:
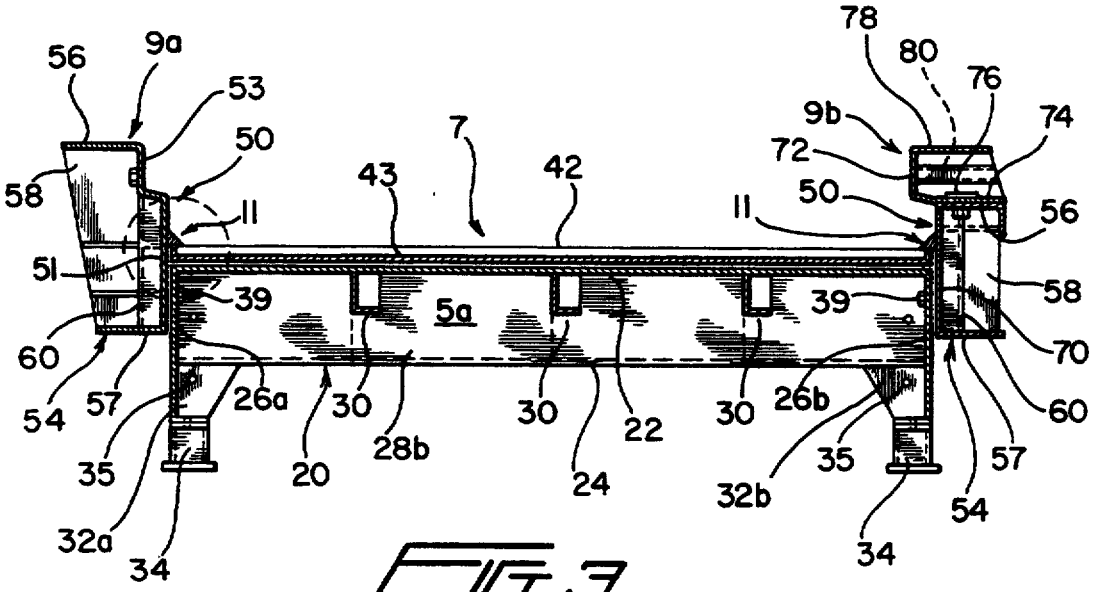
FIG. 3 is a cross-sectional end view of the form system illustrated in FIG. 2 along the line 3—3.

With reference now to FIGS. 1A and 3, each of the bases 5*a–d* includes a box-like support table 20 that is formed from an upper wall 22, a lower wall 24, side walls 26*a,b* and end walls 28*a,b*. In the preferred embodiment, each of the various walls of the support table 20 is formed from ten gauge sheet steel, both for durability as well as for the ability to accurately mold a structural wall panel. Three reinforcing rails 30 are welded to the underside of the upper wall 22 and connected to the end walls 28*a,b* in order to rigidify the upper wall 22 of the base 5*a*. Such rigidification prevents the upper wall 22 from sagging from the weight of the concrete poured into the form during the panel molding operation. At the bottom of the support table 20 are four angular leg flanges 32*a–d*. Four feet 34 may be connected to these leg flanges, if desired. Each of the leg flanges 32*a–d* includes an end bolt hole 35 and a side bolt hole 37. The end bolt holes 35 receives nut and bolts (not shown) which allow the bases 5*a–d* to be connected end to end, while the side bolt holes 37 allow the same bases to be connected side to side if desired. Finally, the side walls 26*a,b* of each of the support tables 20 of the bases 5*a–d* includes a plurality of bolt holes 38 uniformly spaced along its longitudinal axis, as may best be seen in FIG. 1. Welded nuts 39 are secured around each of the bolt holes 38 in the interior of the support table 20, as may best be seen in FIG. 3. The welded nuts 39 threadedly receive bolts which form part of the height adjustable mounting system 13 that secures the side wall members 9*a,b* to the base assembly 3.

With reference now to FIG. 1B, the width of the base assembly 3 may be extended by the use of base width extenders 10*a,b* if relatively small extensions of the width are desired. The structure of each base width extender 10*a,b* is substantially similar to that described with respect to the bases 5*a–d*, with each such extender having inner and outer walls 40*a,b* with a pattern of bolt holes 32 and welded nuts (not shown) that are registrable with the bolt holes 32 of the bases 5*a–d* and the bolt slots 52 of the side wall members 9*a,b*. The right angle flanges at the bottom of each of the inner walls 40*a* serves to rigidify the extender. The only major differences between the base width extenders 10*a,b* and the bases 5*a–d* are that the extenders 10*a,b* include no lower wall 24 or reenforcing rails 30. The lack of these components allows the system operator to freely insert bolts through the bolt holes 41 on the inner walls 40*a* of each extender 10*a,b*, and to ring these bolts into the welded nuts 39 in the interior of the support table 20 of the base 5*a–d*.

With reference now to FIGS. 1A,B, 2 and 3, each of the form liners 7 is dimensioned to cover most or substantially all of the upper surface of the base assembly 3 that it rests upon. Such substantial coveting is important, particularly when the base assembly 3 is formed from two or more bases 5*a–d*, as the form liner 7 defines a single, unitary mold bottom for the resulting form that prevents any unsightly seams or blemishes from being created in the resulting wall panel as a result of concrete running into the small gaps which must necessarily exist between adjacent bases 5*a–d*. The contours 42 of the particular form liner 7 used in the system defines the architectural finish of any structural wall panel molded thereover. While the liner 7 illustrated in FIGS. 1–3 is a vertical-groove type finish 43, the liner 7 can impart any desired type of finish on the resulting wall panel, and the system 1 contemplates the use of not only form liners embossed with different architectural finishes, but liners having a variety of different lengths and widths such that wall panels of widely varying sizes and finishes may be produced by the same system 1. While the form liners 7 may be formed from rubber or plastic, sheet metal is preferred. In the preferred embodiment, each of the form liners 7 includes a pair of side flanges 44*a,b*. As will be discussed hereinafter, these side flanges 44*a,b* advantageously cooperate with alignment flanges on the inner walls of the side members 9*a,b* to form the alignment mechanism 11 which properly and automatically adjusts the height of the side wall members 9*a,b* over the form liners 7 when the form system 1 is assembled.

Figure 6:
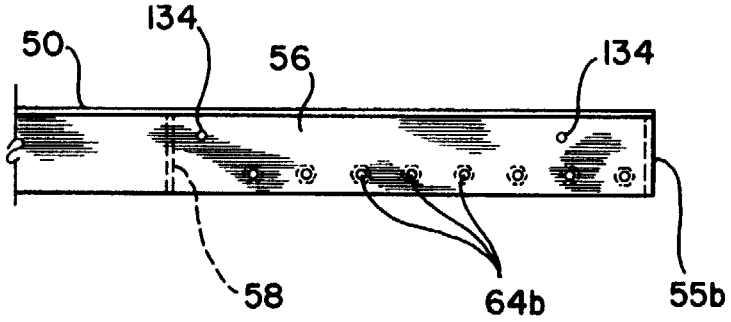
FIG. 6 is a partial elevational view of the side wall member illustrated in FIG. 5, illustrating the bolt holes used in the length adjustable mounting system of the invention.
Figure 5:
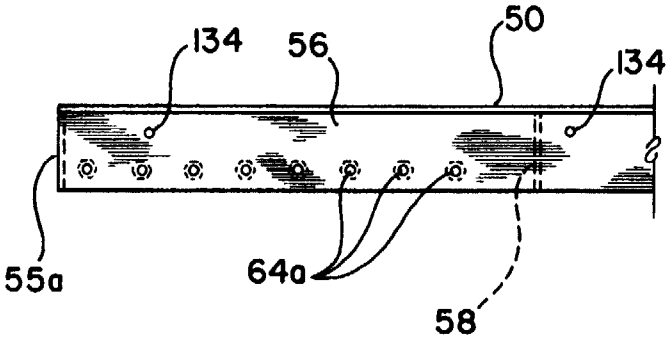
FIG. 5 is a side view of one of the side wall members of the form system.
Figure 5:
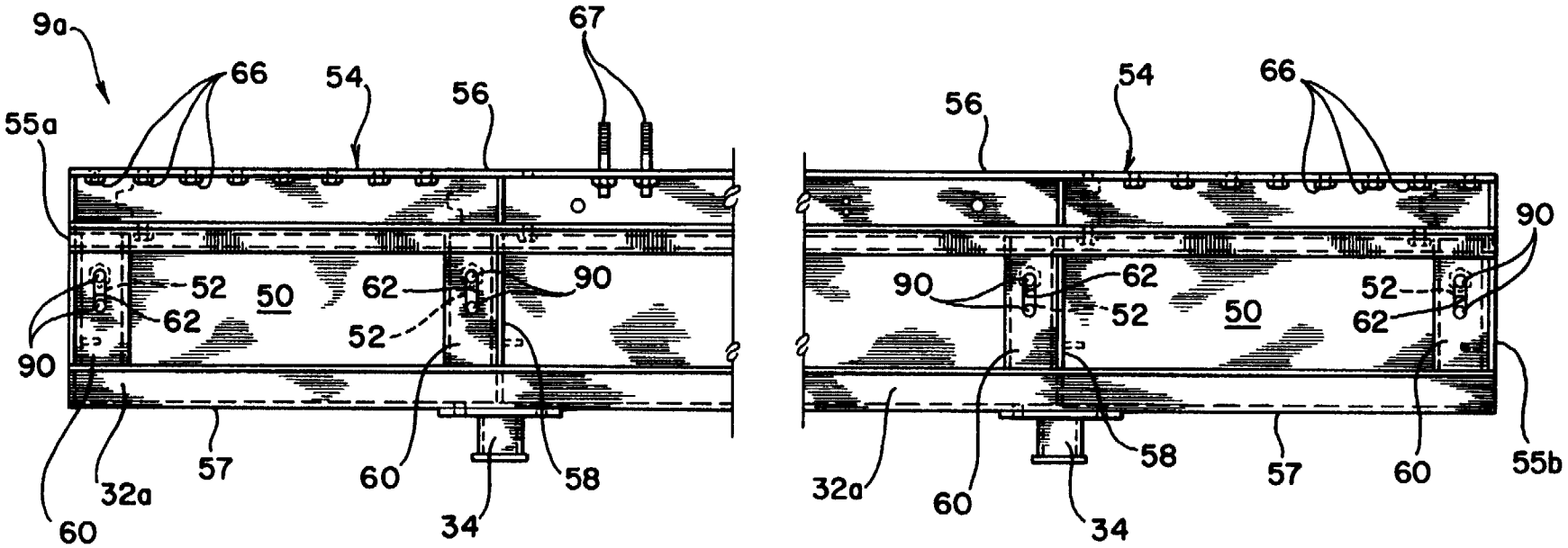
Figure 8B:
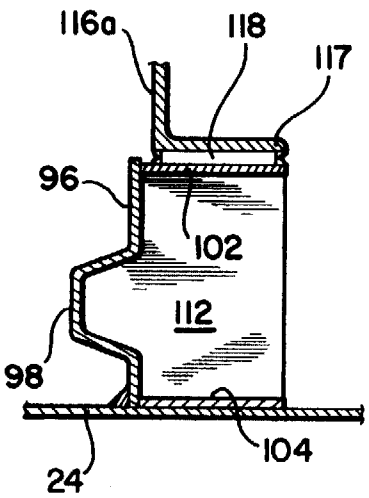
FIG. 8B is a cross-sectional side view of the end wall member and mounting system illustrating in FIG. 8A, along the line 8B—8B.
Figure 8A:
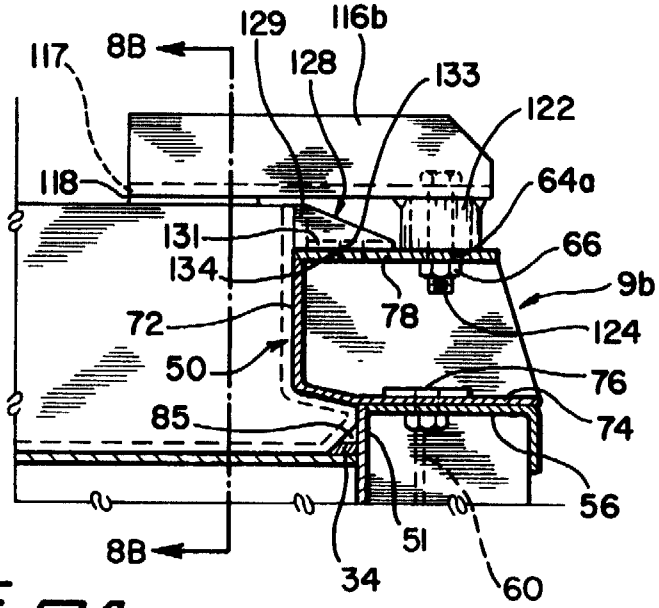
FIG. 8A is a partial cross-sectional end view of the system of the invention, illustrating in particular how the length adjustable mounting system detachably connects the end wall members to the side wall members.
Figure 8A:
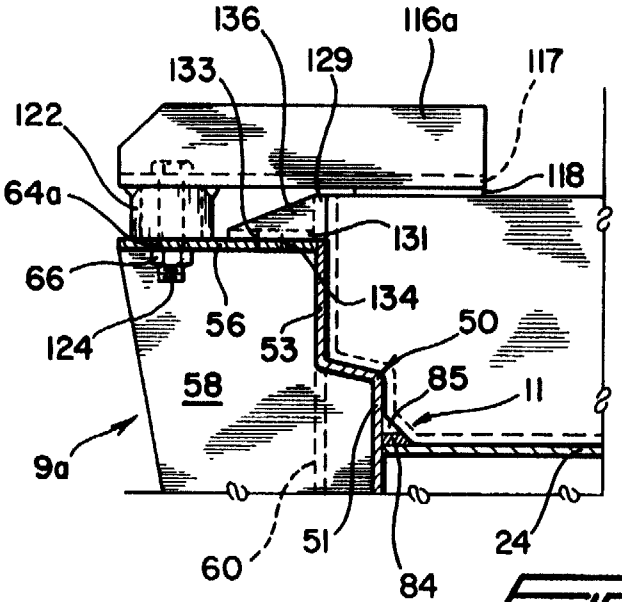

With reference now to FIGS. 5, 6 and 8A, the leftmost side wall member 9*a* includes an inner wall 50 which abuts against the side wall 26*a* of the base and which defines one of the mold surfaces of the form system 1. The inner wall 50 is preferably formed from sheet steel and includes a flat lower portion 51 which includes a plurality of uniformly spaced apart bolt slots 52 (which may best be seen in FIG. 1). The inner wall 50 further includes a recessed upper portion 53 for defining a fib-like protrusion along the side of any wall panel molded thereby. The inner wall 50 is generally rectangular in shape and is stiffened around its perimeter by a reinforcing frame 54. The frame 54 includes end plates 55, and upper and lower frame members 56 and 57 which are welded together at their joints and to the wall 50. The inner side wall 50 is further stiffened by a plurality of reinforcing gussets 58. Such reinforcing advantageously prevents the inner wall 50 from bowing or otherwise distorting in response to the load applied to it by the liquid concrete when the form system i is used to manufacture wall panels. As may best be seen in FIG. 5, a plurality of rectangular bolt lock plates 60 are welded onto the inner edges of the upper and lower frame members 56,57. Each of the bolt lock plates 60 includes a vertically oriented slot 62 in registry with one of the bolt slots 52 of the inner wall 50. The bolt lock plate 60 not only serves to further strengthen the side wall member 9*a*, but also provides a resilient, reactive surface which acts as a lock washer when a bolt is extended through the two slots 52 and 62 and threaded into engagement when one of the welded nuts 39 secured to the interior of the side wall 26*a*. As is most easily seen in FIG. 6, the upper frame member 56 of the side wall member 9*a* includes two sets of bolt holes 64*a,b* on either of its ends. In the preferred embodiment, each of the bolt holes are spaced apart approximately three inches. Welded between each one of the bolt holes 64*a,b* is a nut 66, best seen in FIG. 5. As will be better appreciated hereinafter, the two sets of bolt holes 64*a,b* and welded nut 66 form part of the previously mentioned length adjustable mounting system 17 for the end wall members 15*a,b*. Finally, the upper frame member 56 of the side wall member 9*a* includes a vibrator coupling 67 which may be formed from a pair of bolts as shown. The vibrator connector 67 allows the side member 9*a* to be conveniently connected to a vibrator of the type which helps to remove unwanted bubbles and air pockets from liquid concrete after it has been poured into the mold defined by an assembled form system 1.

With reference now to FIGS. 3 and 8A, the structure of the right hand side wall member 9*b* is similar, but not identical to that of the left hand member 9*a*. While the side wall member 9*b* includes an inner wall 50 which includes vertically oriented, bolt receiving slots spaced apart in the same fashion as that described with respect side wall member 9*a*, and while the flat lower portion 70 of the inner wall 50 is likewise circumscribed by a reinforcing frame 54 that includes reinforcing gussets 58 and bolt lock plates 60, the upper portion 70 of this wall is not integrally formed with the lower portion 70, but instead is detachable therefrom. Specifically, the upper wall portion 72 includes a lower flange 74 that is attached onto the upper frame member 56 by nut and bolt connectors 76. Such detachability is necessitated by the fact that the upper wall portion 72 protrudes into any wall panel molded within the form system, and hence must be removed if the resulting panel is to be lifted out of the form without mechanical interference. The upper wall portion 72 terminates in a top flange 78 which is aligned with the upper frame member 56 of the side wall member 9*a* when the form system 1 is assembled. Like upper frame member 56, top flange 78 likewise includes two sets of bolt holes 64*a,b* at either of its ends, best seen in FIGS. 1 and 2. Nuts 66 are welded beneath each of the bolt holes in the bolt hole set 64*a,b* for a purpose which will become evident shortly.

Figure 4A:
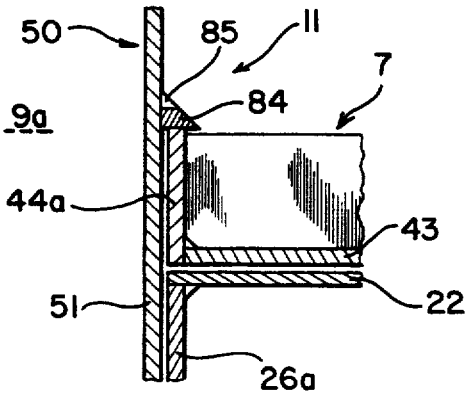
FIG. 4A is an enlargement of the area enclosed in the dotted circle in FIG. 3 illustrating the details of the alignment mechanism of the system.
Figure 4B:
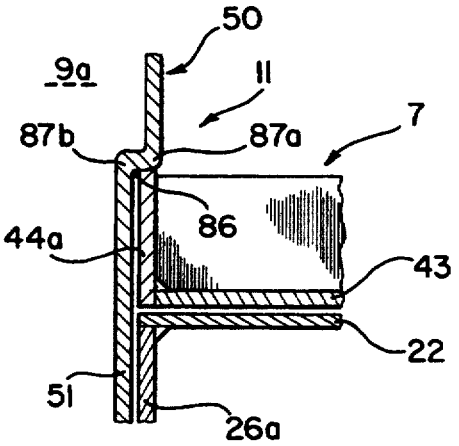
FIG. 4B is an alternative embodiment of the alignment mechanism of the form system.

With reference now to FIG. 4A, the alignment mechanism 11 of the form system 1 includes a tapered flange 84 which is welded along the longitudinal axis of the inner wall 50 of both of the side wall members 9*a,b* by weld bead 85. The flange 84 rests on top of one of the side flanges 44*a* of the form liner 7 disposed over the base assembly 3 when the form is assembled. Weld bead 85 is shaped in conformity with the taper of the flange 84 as shown. Such a tapered shape facilitates the removal of any wall panel molded within the form system 1. When the lower surface of the flange 84 is engaged against the upper edge of the side flange 44*a* as shown in FIG. 4A prior to the securing of the side wall members 9*a,b* to the base assembly 3, the upper edge of the side wall 50 of the side wall members 9*a,b* is properly spaced with respect to the upper surface of the form liner 7. When the side wall panels are secured in this position, any wall panel manufactured by the form system 1 achieves a proper and precise thickness. FIG. 4B shows an alternative embodiment of the alignment mechanism 11 of the invention. In this embodiment, the flange 84 is replaced by a rectangular recess 86 defined by a pair of right angular bends 87*a,b* in the inner wall 50. The relatively smoother mold contours provided by this particular embodiment of the alignment mechanism 11 allows any panel molded within the form system 1 to be removed with somewhat less mechanical interference than with the alignment mechanism 11 of FIG. 4A.

With reference again to FIG. 5, the height adjustable mounting system 13 is formed from a plurality of bolts 90 which extend through the vertically oriented slots 52 and 62 present in the inner walls 50 and bolt lock plates 60 of each of the side wall members 9*a,b*. Through these slots, the threaded ends of the bolts 90 extend through the bolt holes 38 present on either side of the bases 5*a–d* forming the base assembly 3, and from thence into the nuts 39 welded around the inner periphery of these holes 38 in the interior of the base. In operation, when the nuts 90 are slightly loosened, the side wall members 9*a,b* can be slid upwardly or downwardly (or even tilted slightly away from their respective base) to allow an operator to slide a desired form liner 7 over the upper surface of the base 5*a* and then to vertically adjust the position of the side wall members 9*a,b* such that the inner flange 84 (or rectangular recess 86) of the alignment mechanism 11 overlies one of the side flanges 44*a,b* of the form liner 7 in the position illustrated in FIG. 4A. Once such alignment is achieved, the bolts 90 can be tightened until the side members are firmly and rigidly secured to the base assembly 3.

Figure 7B:
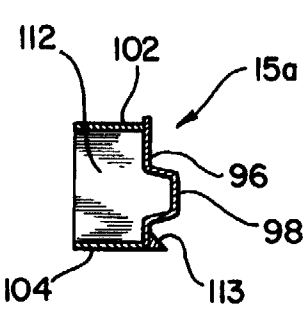
FIG. 7B is a cross-sectional view of the end wall member illustrated in FIG. 7A, along the lines 7B—7B.
Figure 7A:
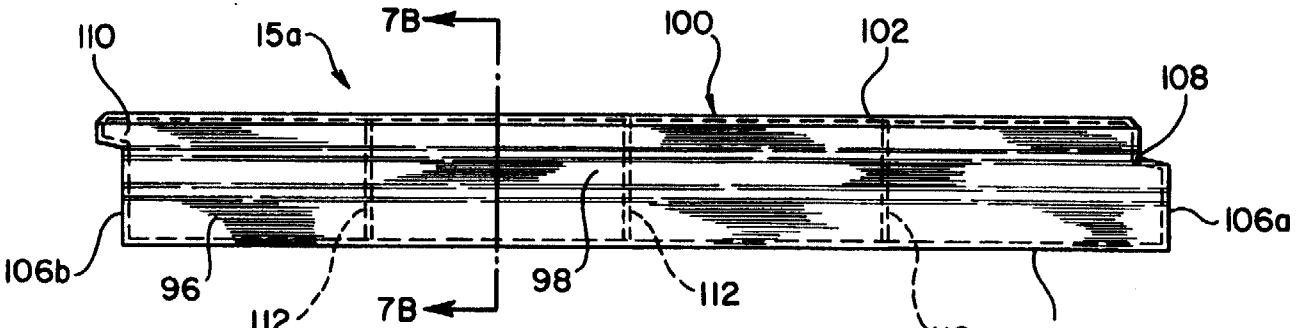
FIG. 7A is a side view of one of the end wall members of the form system.

With reference now to FIGS. 7A and 7B, each of the end wall members 15*a,b* includes an inner wall 96 formed from thick gauge sheet steel which forms the part of the mold surface of the form system 1. The inner wall 96 may be provided with a protruding rib 98 for creating a recess in the wall panel molded therefrom or it may be provided with a longitudinal recess if the formation of a rib on the end of the wall panel is desired. Similar to the previously described side wall members 9*a,b*, the inner wall 96 of each of the end wall members 15*a,b* is circumscribed by a support frame 100 that comprises an upper frame member 102, a lower frame member 104, and side walls 106*a,b*. One side of each of the end wall members includes a recess 108, while the other includes a protrusion 110, the recess and protrusion being complementary in shape to the inner wall 50 of the particular side wall member 9*a,b* that it abuts against when assembled. Three or more sheet metal gussets 112 are welded within the support frame 100 for added strength. Finally, a tapered lip 113 is provided along the bottom edge of the inner wall 96 to facilitate the removal of any wall panel manufactured by the form system 1.

With reference now to FIGS. 8A and 8B, the length adjustable mounting system 17 which adjustably and detachably secures each of the end wall members 15*a,b* to the form system 1 includes a pair of side brackets 116*a,b* formed from steel angles as shown. The bottom flange 117 of each of the side brackets 116*a,b* is welded to a plate spacer 118, which in turn is welded onto the top surface of the upper frame member 102. A bolt hole 120 is provided at the distal end of the bottom flange 117 of each of the side brackets 116*a,b*. Additionally, a tubular spacer 122 (which may be manufactured from a short section of steel pipe) is welded around the bolt hole 120 of each of the brackets 116*a,b*. In operation, a bolt 124 is slid through the bolt hole 120 of each of the side brackets 116*a,b* when that hole is aligned with a desired one of the bolt holes 64*a,b* present on either end of the side wall members 9*a,b*. The bolt 124 is then screwed into the welded nut 66 circumscribing the selected one of the bolt holes 64*a,b*.

The form system 1 also includes a pair of wall extenders 128 which may optionally be used to extend the height of the mold surfaces defined by the inner walls 50 of the side wall members 9*a,b*. Each of the wall extenders 128 includes a vertical flange 129 that is aligned co-planar with the inner wall 50 when it is secured into position by means of a nut and bolt (not shown). Each of the wall extenders 128 further includes a horizontal flange 131 having a bolt hole 133 that is registrable with an inner bolt hole 134 that is also present on the upper surfaces of each of the side wall members 9*a,b*.

In the first step of the method of the invention, the operator of the form system determines the length and width of the particular kind of structural wall panel that he desires. The selected width and length will, of course, determine how many bases 9*a–d* will be interconnected to form the base assembly 3, or how many base width extenders 10*a,b* will be connected to a single base 5*a–d* to form the base assembly 3. Once these decisions have been made and the appropriate number of bases and/or base width extenders 10*a,b* have been bolted together by aligning the appropriate bolt holes, the system operator determines what type of architectural finish the wall panels produced by the system 1 should have. Once the particular type of finish has been selected, a form liner 7 having the selected finish embossed in its interior is next placed over the upper surface of the base assembly 3. In the next step of the method, the side wall members 9*a,b* are properly vertically aligned with respect to the bottom surface of the form liner 7 by placing either the previously described flange 84 or recess 86 of the alignment mechanism 11 over the particular side flange 44*a,b* of the form liner 7 that it faces. Such vertical alignment may be easily done with the bolts 90 of the height adjustable mounting system 13 in a loosened state, as has been previously described. Once the desired vertical alignment has been achieved, the bolts 90 of the system 13 are then tightened. In the next step of the method, the system operator determines what particular thickness the resulting wall panels should have. Specifically, if the system operator decides that the resulting wall panels should be thicker than the distance between the upper edges of the side wall members 9*a,b* in the upper surface of the form liner 7, the previously described wall extenders 128 are secured on the upper edges of the side wall members 9*a,b* in the manner previously described. The system operator then determines what length the resulting wall panels should have. He then proceeds to install the end wall members 15*a,b* between the side wall members 9*a,b* in such a way that the distance between the end wall members 15*a,b* corresponds to the selected length of the resulting wall panel. This step is, of course, implemented by bolting the ends of the side brackets 116*a,b* of each of the end wall members 15*a,b* to selected ones of the previously described bolt holes 64*a,b* present on the upper surfaces of each of the side wall members 9*a,b*. In preforming this step of the method, it is important to note that the provision of two separate sets of bolt holes 64*a,b* at both ends of each of the side wall members 9*a,b* allows the system operator to achieve the selected length of the resulting panel with more than one combination of bolt holes. This capability advantageously allows the system operator to achieve not only a desired panel length, but a desired symmetry with respect to the architectural finish embossed on the upper surface of the form liner 7.

In the next step of the method, a pattern or gridwork of reinforcing steel is laid into the form system 1, and concrete is then poured into the mold surface defined by the upper surface of the form liner, and the inner surfaces of the side wall members 9*a,b* and end wall members 15*a,b* until the concrete reaches the upper edge of the side wall members 9*a,b*. After the concrete hardens, the end wall members 15*a,b* are removed by removing the bolts 124 of the length adjustable mounting system 17, and the upper wall portion 72 of the side wall member 9*b* is removed. The newly manufactured wall panel is then removed from the form system 1 and the process is repeated until the desired number of wall panels of the selected length, width and thickness and architectural finish is fabricated.

While certain modifications, rearrangements and alternate embodiments of both the system and the method of the invention will become evident to persons of ordinary skill in the art, all such modifications, variations and embodiments are intended to be encompassed within the scope of this patent, which is limited only by the claims appended hereto.

I claim:

1. A form system for the molding of pre-cast structural wall panels from a hardenable, cementitious material in a variety of different rectangular shapes and with a variety of different architectural finishes, and for a variety of different wall systems comprising:

at least one rectangular base for supporting a quantity of fluent cementitious material that hardens after being poured;

at least two form liners supportable by said base for defining the bottom of a mold space and for imparting an architectural finish to panels molded by said system, each of said form liners including a pair of opposing parallel side edges, the height of said side edges varying between different form liners;

at least one pair of elongated side wall members for defining the sides of said mold space, wherein each of said members includes an upper edge;

means for adjustably securing said elongated side wall members on opposing sides of said base at a plurality of different heights between a maximum and a minimum height;

means for aligning the upper edges of each of said side wall members at a preselected height relative to the side edges of said form liner such that the thickness of panels molded by said system remains constant despite said variations in the heights of said side edges of said form liners;

end wall members for defining the end walls of said mold space, and means for detachably mounting said end wall members at any one of the plurality of positions along the longitudinal axis of said side wall members.

2. The form system of claim 1, wherein said alignment means includes a flange on each of said side wall members for engaging one of said side edges of said form liner.

3. The form system of claim 2, wherein said flange supports the weight of its respective side wall member when it engages its respective side edge of said form liner.

4. The form system of claim 1, wherein said adjustable securing means includes a plurality of vertically oriented slots, and a plurality of bolts extendable through said slots, wherein said maximum and minimum height of each of said side members is determined by the length of said slots.

5. The form system of claim 1, wherein said detachable mounting means includes opposing bracket members affixed to a top edge of each of said end wall members, each of which includes a free end extending over the sides of its respective end wall member and means for mounting the free ends of said bracket members to the upper edge of one of said side wall members.

6. The form system of claim 1, wherein said cementitious material is concrete, and further comprising a means for coupling a vibrator to said form system to remove air bubbles from said concrete after it is poured into said form system and before it has an opportunity to harden.

7. The form system of claim 6, wherein said coupling means includes at least one bolt shank mounted on each of said side wall members.

8. The form system of claim 2, wherein said form liner includes vertically oriented flanges on its side edges that engage said side wall member flanges sufficiently closely to substantially prevent said cementitious material from running out of said form system.

9. The form system of claim 1, further comprising an extension member for each of said side wall members that is detachably connectable to the upper edge of its respective side wall member for increasing the height of the mold space defined by the side wall members.

10. The form system of claim 1, wherein said system includes at least first and second rectangular bases of the same size, and means for detachably connecting said bases end-to-end or side-to-side to create a single, larger base assembly that is either longer or wider than either said first or second bases.

11. A form system for the molding of pre-cast structural wall panels from a hardenable cementitious material in a variety of different rectangular shapes and with a variety of different architectural finishes, and for a variety of different wall systems, comprising:

at least one rectangular base for supporting a quantity of fluent cementitious material that hardens after being poured;

at least two form liners supportable by said base for defining the bottom of a mold space and for imparting an architectural finish to panels molded by said system, each of said form liners including a pair of opposing parallel side edges, the height of said edges varying between different form liners;

at least one pair of elongated side wall members for defining the sides of said mold space, wherein each of said members includes an upper edge;

means for adjustably securing said elongated side wall members on opposing sides of said base at a plurality of different heights between a maximum and a minimum height;

means for aligning the upper edges of each of said side wall members at a preselected height relative to the side edges of said form liners such that the thickness of panels molded by said system remains constant despite variations in the heights of said side edges of said form liners;

end wall members for defining the end walls of said mold space, and means for detachably mounting said end wall members at any one of the plurality of positions along the longitudinal axis of said side wall members, wherein said system includes at least first and second rectangular bases of the same size, and means for detachably connecting said bases end-to-end or side-to-side to create a single, larger base assembly that is either longer or wider than either said first or second bases.

12. The form system of claim 11, further comprising at least one form liner supportable by said base assembly that covers the area where said first and second bases are joined.

13. The form system of claim 11, further comprising at least two end wall members for defining the width of the mold space created by said two attached bases.

14. The form system of claim 11, wherein said detachable mounting means includes opposing bracket members affixed to a top edge of each of said end wall members, each of which includes a free end extending over the sides of its respective end wall member and means for mounting the free ends of said bracket members to the upper edge of one of said side wall members.

15. The form system of claim 11, wherein cementitious material is concrete, and further comprising a means for coupling a vibrator to said form system to remove air bubbles from said concrete after it is poured into said form system and before it has an opportunity to harden.

16. The form system of claim 15, wherein said coupling means includes at least one bolt shank mounted on each of said side wall members.

17. The form system of claim 11, wherein said form liner includes vertically oriented flanges on its side edges that engage said side wall member flanges sufficiently closely to substantially prevent said cementitious material from running out of said form system.

18. The form system of claim 11, further comprising an extension member for each of said side wall members that is detachably connectable to the upper edge of its respective side wall member for increasing the height of the mold space defined by the side wall members.

19. The form system of claim 15, an extension member for each of said side wall members that is detachably connectable to the upper edge of its respective side wall member for increasing the height of the mold space defined by the side wall members and further comprising wherein said means for detachably mounting said end wall members between said side member includes spacer means for connecting said free bracket ends to said side wall members over said extension members.

* * * * *